US006499490B1

(12) United States Patent
Saito et al.

(10) Patent No.: US 6,499,490 B1
(45) Date of Patent: Dec. 31, 2002

(54) METHOD FOR PRODUCING A HEAT-IRREVERSIBLY COAGULATED GLUCAN SHEET CONTAINING A LEAF TOBACCO EXTRACT AND METHOD FOR PRODUCING A TOBACCO FLAVOR-GENERATING MEDIUM USING A HEAT-IRREVERSIBLY COAGULATED GLUCAN SHEET

(75) Inventors: Yutaka Saito, Yokohama (JP); Yuriko Anzai, Yokohama (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 09/168,175

(22) Filed: Oct. 8, 1998

(30) Foreign Application Priority Data

Oct. 8, 1997 (JP) ..... 9-275904

(51) Int. Cl.[7] ..... A24B 3/14

(52) U.S. Cl. ..... 131/369; 131/370; 131/372; 131/274; 131/275; 426/89; 426/103; 424/490; 424/493

(58) Field of Search ..... 131/369, 370, 131/372, 274, 276, 275; 426/89, 103; 424/490, 493

(56) References Cited

U.S. PATENT DOCUMENTS

| | | | | |
|---|---|---|---|---|
| 5,778,899 | A | 7/1998 | Saito et al. | |
| 5,845,649 | A * | 12/1998 | Saito et al. | 131/352 |

FOREIGN PATENT DOCUMENTS

| | | | |
|---|---|---|---|
| EP | 0691084 | A1 | 1/1996 |
| GB | 1517547 | A | 7/1978 |
| JP | 53130755 | A | 11/1978 |
| JP | 53133697 | A | 11/1978 |
| WO | 9520329 | | 8/1995 |
| WO | 9520330 | | 8/1995 |

* cited by examiner

*Primary Examiner*—Christopher A. Fiorilla
*Assistant Examiner*—Mark Halpern
(74) *Attorney, Agent, or Firm*—Birch, Stewart, Kolasch & Birch, LLP

(57) ABSTRACT

A leaf tobacco extract or a concentrate thereof is used as a dispersion medium, which is mixed with powder of a heat-irreversibly coagulating glucan and a dispersion interference-preventing agent including an organic acid. The resultant mixture is stirred to disperse the powder of glucan into the dispersion medium, thereby preparing a slurry having an increased viscosity. This slurry is formed into a sheet, which is then heated and coagulated.

14 Claims, No Drawings

METHOD FOR PRODUCING A HEAT-IRREVERSIBLY COAGULATED GLUCAN SHEET CONTAINING A LEAF TOBACCO EXTRACT AND METHOD FOR PRODUCING A TOBACCO FLAVOR-GENERATING MEDIUM USING A HEAT-IRREVERSIBLY COAGULATED GLUCAN SHEET

BACKGROUND OF THE INVENTION

The present invention relates to a method for producing a heat-irreversibly coagulated glucan sheet, and more particularly to a method for producing a heat-irreversibly coagulated glucan sheet which contains a leaf tobacco extract and can be used as a substitute for a tobacco. The present invention also relates to a method for producing a tobacco flavor-generating medium using the heat-irreversibly coagulated glucan sheet obtained by this method.

International Publications PCT WO95/20329 and PCT WO95/20330 disclose a flavor-generating material wherein a flavor component is held within a heat-irreversibly coagulated glucan such as curdlan. This flavor-generating material is said to be excellent in stability of holding the flavor component therein, easily emit the flavor component upon burning or heating, and does not generate any flavor-interfering materials, such as an unpleasant stimulus, pungent or fibrous odor substances upon burning or heating.

To produce the flavor-generating material noted above, powder of a heat-irreversibly coagulating glucan is firstly added to a large amount of water and is dispersed under high speed stirring to obtain an aqueous glucan dispersion (slurry) having a high viscosity. Next, a small amount of a flavor component is incorporated into this aqueous glucan dispersion, and the mixture is stirred in the same manner as above. Subsequently, the obtained glucan slurry is cast into a sheet, which is then thermally coagulated (gelled) to obtain a heat-irreversibly coagulated/gelled glucan gel sheet. This glucan gel sheet is cut or pulverized to be used as a flavor-generating material in various flavor-tasting or smoking products.

Incidentally, in recent years, a substitute for a tobacco, containing a leaf tobacco extract as a flavor component has been demanded.

To produce such a tobacco substitute by utilizing the technique of producing the flavor-generating glucan gel sheet noted above, it may suffice to add the leaf tobacco extract as a flavor component to the above-noted aqueous glucan dispersion.

However, the present inventors have found that it is almost impossible to cause a large amount of the leaf tobacco extract to be incorporated within the flavor-generating glucan gel sheet due to problems such as dispersion interference against the aqueous glucan dispersion. Thus, to release sufficient tobacco flavor from final flavor-tasting articles, it is necessary to use a relatively large amount of glucan containing the leaf tobacco extract obtained by the prior art methods.

BRIEF SUMMARY OF THE INVENTION

Therefore, an object of the present invention is to provide a method for producing a heat-irreversibly coagulated glucan sheet, which makes it possible to produce a glucan gel sheet containing a relatively large amount (content) of a leaf tobacco extract.

According to one aspect of the present invention, there is provided a method for producing a heat-irreversibly coagulated glucan sheet, comprising the steps of:

(a) preparing a mixture containing a leaf tobacco extract or a concentrate thereof, as a dispersion medium, a dispersion interference-preventing agent comprising an organic acid, and powder of heat-irreversibly coagulating glucan;

(b) stirring the mixture to disperse the powder of the glucan into the dispersion medium, thereby forming a slurry having an increased viscosity;

(c) forming the slurry into a sheet-like form; and (d) heating and coagulating the resultant sheet-like formed body.

In the present invention, the dispersion interference-preventing agent preferably comprises an organic carboxylic acid. In particular, malic acid, a citric acid, a tartaric acid, succinic acid, lactic acid and mixtures thereof are more preferable.

In the present invention, preferably, the glucan is curdlan.

In another aspect of the present invention, there is provided a method for producing a tobacco flavor-generating medium, comprising the steps of cutting or pulverizing the heat-irreversibly coagulated glucan sheet prepared by the above method according to the present invention to obtain a tobacco flavor-generating material; mixing the tobacco flavor-generating material with sheet tobacco materials; forming the resultant mixture into a sheet-like form; and cutting or pulverizing the resultant sheet-like formed body.

DETAILED DESCRIPTION OF THE INVENTION

The present inventors have attempted, following the prior art methods for producing a glucan gel sheet mentioned above, to add a larger amount of a leaf tobacco extract than the amount used in the prior art methods to an aqueous glucan dispersion prepared in advance, and to coagulate or gel the sheet. As a result, it was found that at most about 20% by weight of the leaf tobacco extract was held within the obtained glucan gel.

Then, the present inventors thought that, in order that a larger amount of the leaf tobacco extract would be contained and held within the glucan gel sheet, it was sufficient to use the leaf tobacco extract, instead of water, as a dispersion medium for the glucan, in preparing the glucan dispersion; thus, the inventors attempted to disperse powder of glucan into a large amount of the leaf tobacco extract under high speed stirring.

Unexpectedly, however, it was found that a dispersion interference phenomenon occurred that the viscosity of the glucan dispersion (slurry) was not increased to a viscosity sufficient to form a sheet due to poor dispersion of gulcan in the medium, or a gelation interference phenomenon occurred that when this dispersion was cast into a sheet and thermally coagulated or gelled, the strength of the resultant gel was insufficient as a result of the dispersion interference phenomenon.

Investigating causes for the above, the present inventors found that the dispersion and gelation of the glucan were interfered by hydrophilic materials dissolved in the leaf tobacco extract, hydrophobic materials present in a form of oils or solids which are not dissolved in the extract, fibrous dust present as fine particles in the extract, and the like materials. When the dispersion of the glucan is interfered, the viscosity of the slurry is not increased sufficiently, resulting in flowing-out of the slurry, casting-failure or scattering of the slurry and the like in the step of forming a sheet, and further resulting in reduction in gel strength in a subsequent thermal gelation step, leading to the interference of the formation of the gel. When the formation of the gel is interfered, sheet physical properties such as strength remarkably deteriorate and the stable sheet formation becomes difficult. In addition, the effect of incorporating the leaf tobacco extract within the glucan gel is decreased, and stability of holding the leaf tobacco extract and duration property of release thereof are remarkably deteriorated.

To overcome these problems, the present inventors have conducted extensive studies to find that the dispersion interference can be prevented if at least one organic acid is added in dispersing powder of the glucan into the leaf tobacco extract (or a concentrate thereof as a dispersion medium for glucan, making it possible to produce a heat-irreversibly coagulated glucan sheet holding the leaf tobacco extract at a higher content and with good stability and a satisfactory strength.

The present invention will be described in detail below.

In the present invention, firstly, a mixture is prepared which contains a leaf tobacco extract or a concentrate thereof as a dispersion medium, a dispersion interference-preventing agent comprising an organic acid, and powder of a heat-irreversibly coagulating glucan.

In the present invention, the leaf tobacco extract which is used as a dispersion medium for the heat-irreversibly coagulating glucan can be obtained by a conventional method. For example, 20 to 200 parts by weight of a leaf tobacco can be added to 1000 parts by weight of water, and then this mixture is stirred, while being heated at, for example, 10° C.–90° C., so as to extract a leaf tobacco extract. The mixture is filtered using a filter having an average pore size of 5 to 10 $\mu$m. The leaf tobacco extract obtained as a filtrate may be used as it is, or as a concentrate in which the extract is concentrated by 1 to 70% by weight. As a leaf tobacco extract, a leaf tobacco extract from which nicotine is removed may be used. Powder of the leaf tobacco extract can be dissolved into water to reconstitute a leaf tobacco extract or a concentrate thereof, but, this is not efficient.

The heat-irreversibly coagulating glucan used in the present invention is known per se. For example, curdlan, which is most preferably used in the present invention, is a straight chain β-1,3-glucan wherein about 400–500 D-glucose molecules are β-glucoside linked with each other at their 1–3 positions. It is water-insoluble and is insoluble in almost all organic solvents. Glucan is also safe for the human body. Such glucan is commercially available in a powder form.

In the present invention, the dispersion interference-preventing agent comprises at least one organic acid. As this organic acid, carboxylic acids are preferable. Among the carboxylic acids, malic acid, citric acid, tartaric acid, succinic acid, lactic acid and mixtures thereof are especially preferable in that they do not have any bad influence on the flavor and taste of the leaf tobacco extract and they exhibit higher effect of preventing the dispersion interference. The organic acid is added preferably in an amount of 30% or less, more preferably in an amount of 1–10% by weight, of the leaf tobacco extract or a concentrate thereof used.

The order of addition of the dispersion interference-preventing agent and the heat-irreversibly coagulating glucan to the leaf tobacco extract or a concentrate thereof is not particularly limited. Either one of them may be first added, or they may be added at the same time.

The mixture thus obtained is stirred at a high speed to disperse the glucan the leaf tobacco extract or a concentrate thereof. Thus, a slurry having an increased viscosity (for example, 4,000–8,000 mPa·s at 25° C.) can be obtained. Preferably, this slurry preparation is carried out at a temperature of from 20 to 30° C. under stirring with a mixer. If the amount of the glucan such as curdlan to be dispersed into the leaf tobacco extract or a concentrate thereof is too large, the viscosity of the slurry becomes so high that the formation of the slurry which can be easily handled is liable to become difficult. Therefore, the glucan, in particular curdlan, should preferably be present in a concentration of from 1 to 20% by weight, more preferably from 3 to 5% by weight of the leaf tobacco extract or a concentrate thereof.

Incidentally, it has been found that in order to hold the leaf tobacco extract within the heat-irreversibly coagulated glucan sheet in a larger amount or more stably, it is preferable to prepare a dissolved matter in which an emulsifier, preferably that known as a food additive (for example, a glycerin fatty acid ester, a sucrose fatty acid ester, a sorbitan fatty acid ester and a propyleneglycol fatty acid ester, and lecithine) is dissolved in an oily solvent (for example, any vegetable oil or saturated fatty acid triglyceride), and to add the dissolved matter to the aforementioned mixture or dispersion containing the glucan. An especially preferable oily solvent is middle-chain saturated fatty acid triglyceride (MCT), which can dissolve almost all of the hydrophobic components in the leaf tobacco extract, has very high stability against oxidization since it does not contain unsaturated fatty acids and can be easily handled because of its low viscosity. The emulsifier, if used, allows for the preparation of a preferable emulsion having the leaf tobacco extract uniformly dispersed and held therein.

To impart flexibility to the heat-irreversibly coagulated glucan sheet to be obtained so that the sheet can be easily stripped or pealed from its support, it is also preferable to add, to the above-mentioned glucan-containing mixture or the glucan dispersion, a softening agent comprising a polyhydric alcohol (for example, glycerin or propyleneglycol and the like) and/or a saccharide (for example, a monosaccharide such as glucose or fructose; a disaccharide such as maltose, saccharose or lactose; a polysaccharide such as cellulose or starch; an oxidized derivative thereof such as aldonic acid or uronic acid; and a sugar alcohol such as sorbitol). It is possible to adjust the flexibility of the obtained heat-irreversibly coagulated glucan sheet by adjusting the ratio of the polyhydric alcohol and saccharide used.

After the glucan is dispersed into the leaf tobacco extract and preferably other components such as the emulsifier and the oily solvent are added thereinto to prepare a glucan slurry having a high viscosity in such a manner as above, this glucan slurry is optionally subjected to a deforming treatment under a reduced pressure and is cast into a thin sheet onto a suitable supporter (for example, a stainless belt). The resultant cast sheet is heated and dried at such a temperature that glucan is heat-irreversibly coagulated/gelled (at a temperature of from 80 to 140° C., for example in case of curdlan), whereby water is removed off to, for example, 10% of the total weight and the glucan is heat-irreversibly coagulated/gelled in a state wherein the glucan firmly fixes and holds the leaf tobacco extract therein. Thus, a heat-irreversibly coagulated glucan sheet (glucan gel sheet) can be obtained. This gelation is effected only by heating, without any gelling agent being used. The obtained glucan gel sheet is thermally stable. Even if it is again heated, the sheet is not melted.

The glucan sheet holding the leaf tobacco extract therein, obtained as above, can be easily stripped from the support. If necessary, the glucan gel sheet may be humidified and conditioned when it is stripped.

The heat-irreversibly coagulating glucan gel sheet obtained according to the present invention has an excellent tobacco flavor-releasing property that the leaf tobacco extract, which is the flavor component, is hardly released under ordinary preservation conditions (for example, 22° C. and a relative humidity of 60%), but the tobacco flavor component is released immediately upon burning or heating (for example, from 200 to 300° C. or higher), and does not generate any unpleasant flavor nor odor upon burning or heating. The glucan gel sheet obtained according to the present invention is insoluble in water and is insoluble in almost all organic solvents. The glucan gel sheet can contain up to 90% by weight of the leaf tobacco extract.

Preferably, amounts of the respective components in the final glucan gel sheet are, on dry weight basis, as follows.

Preferably, glucan, in particular curdlan, is incorporated into the final glucan gel sheet in an amount of 2 to 70% by weight. If the amount of the glucan is more than 70% by weight, the flexibility of the resultant gel tends to deteriorate. If the amount of glucan is less than 2% by weight, the gel formation is liable to be incomplete. More preferably, the glucan is incorporated into the final glucan gel sheet in an amount of 10 to 40% by weight.

Preferably, the oily solvent is incorporated into the final glucan gel sheet in an amount of 30% by weight or less. If the-amount is more than 30% by weight, the oily solvent tends not to be included within the resultant glucan gel so that the solvent is liable to be leaked to the outside of the glucan gel. More preferably, the oily solvent is incorporated into the final glucan gel sheet in an amount of 3 to 15% by weight.

Preferably, the emulsifier is incorporated into the final glucan gel sheet in an amount of 30% by weight or less. If the amount is more than 30% by weight, the emulsifier tends not to be included within the gel so that the emulsifier is liable to be leaked to the outside of the glucan gel, as in the case of the oily solvent. Therefore, it is preferable that the total amount of the oily solvent and the emulsifier be 30% by weight or less. The ratio of the oily solvent to the emulsifier is optimally 2 to 1. More preferably, the amount of the emulsifier is 2 to 15% by weight.

The polyhydric alcohol and the saccharide are incorporated into the final glucan sheet, preferably in an amount of 50% by weight or less, in total. A more preferable total amount is 5 to 30% by weight.

In such a manner as disclosed in International Publication PCT WO95/20330, the leaf tobacco extract-containing glucan gel sheet obtained according to the present invention is cut or pulverized to prepare a tobacco flavor-generating material in a cut or powder form, which material can optionally be blend with a cut tobacco and/or cut tobacco substitute to prepare a burnable smoking material (tobacco flavor-generating medium). By using this material, a burnable smoking product or a cigarette can be produced.

Alternatively, the tobacco flavor-generating material comprised of cuts or powder of the glucan gel sheet of the present invention can be used as a flavor-generating material for generating tobacco flavor in a heating type flavor-tasting article which can be heated without being accompanied by burning smoke of tobacco leaves, as disclosed in PCT WO95/20329. This article comprises the aforementioned flavor-generating medium containing the flavor-generating material which can release a sufficient amount of the flavor component only by heating, and a heating source which is provided physically separated from this flavor-generating medium and is used for heating the flavor-generating medium to release the flavor component from it.

Preferably, the tobacco flavor-generating material comprising cuts or powder of the glucan gel sheet of the present invention is kneaded into a conventional sheet tobacco materials and is shaped into a sheet-like form. The obtained sheet can be cut or pulverized by a hammer mill to prepare a tobacco flavor-generating medium in a cut or powder form. This tobacco flavor-generating medium, alone or in combination with another flavor component (for example, cut tobacco), can constitute the flavor-generating medium in the aforementioned smoking article or heating type tobacco flavor-tasting article. A typical composition of a rolled sheet tobacco materials containing the tobacco flavor material of the present invention is as follows: 100 parts by weight of tobacco powder (or cellulose or dolomite), 5 to 20 parts by weight of a reinforcing material (such as tobacco fibers or pulp), 1 to 15 parts by weight of a binder (such as carboxymethylcellulose), 1 to 40 parts (preferably from 5 to 20 parts) by weight of cuts or powder of a glucan gel sheet of the present invention (tobacco flavor-generating material), and a necessary amount of water. The composition may optionally contain suitable amounts of optional components such as a humectant (such as glycerin) and a conventional water-resistant agent. The cuts or powder of the glucan gel sheet of the present invention may be kneaded into another sheet tobacco such as a slurry sheet tobacco.

The method of the present invention wherein an organic acid is used as a dispersion interference-preventing agent can be used not only in case of dispersing the glucan into the leaf tobacco extract or a concentrate thereof as a dispersion medium, but also in case of using, as a dispersion medium for glucan, any one of glucan dispersion-interfering solutions comprising extracts extracted from other plant portions (such as leaves of a tea plant, beans, marine plants, fruits and flowers), as well as hydrophilic and hydrophobic materials, particles such as powder, and the like.

The present invention will be described below by way of Examples.

EXAMPLE 1

100 g of a flue cured leaf tobacco were added into 1000 g of water, and the mixture was stirred at a stirring rotation speed of 450 rpm for 30 minutes while being heated at 50° C. to extract a leaf tobacco extract. The mixture was then filtered to give a desired aqueous leaf tobacco extract.

To the entire amount (710 g) of the aqueous leaf tobacco extract, 1.9 g of malic acid and 28 g of powder of curdlan, together with a solution (7.5 g) of 2.8 g of lecithine dissolved in 4.7 g of MCT, were added, and then this mixture was stirred at a stirring rotation speed of 3000 rpm while being kept at a temperature of 25° C., to disperse the curdlan into the aqueous leaf tobacco extract. To the obtained dispersed material, 9.3 g of glycerin and 9.3 g of sorbitol were added and the mixture was stirred under the same stirring conditions to give a curdlan slurry having an increased viscosity.

A portion of this curdlan slurry was taken off, and its viscosity was measured by using a B-type viscosimeter at 25° C., and then was heated at a temperature 100° C. for 10 minutes to be gelled. A strength of the obtained gel was measured at 20° C. by using a rheometer.

Next, the remainder of the aforementioned curdlan slurry was cast into a sheet-like form onto a stainless belt, and then gelled at 110° C. and dried to give a curdlan gel sheet. The formation state of the curdlan gel sheet was observed and evaluated. The formation state of the sheet was evaluated according to the following 3 criteria.

Good: No problems were observed about the stripping property from the stainless belt, and the sheet had no pinholes nor cracks.

Bad: Problems were observed in some about the stripping property, (including the case wherein it was difficult to strip the sheet from the belt). The sheet had pinholes or cracks.

Sheet formation was impossible: Many cracks were observed, and formation into a sheet-like form was impossible.

Results obtained are shown in the Table 1 below. This curdlan gel sheet contained 40% by weight of the leaf tobacco extract.

COMPARATIVE EXAMPLE 1

The same procedures as in Example 1 were followed except that malic acid was not added. The same measurement and evaluation were then carried out. Results thus obtained are also shown in Table 1.

TABLE 1

| | Slurry Viscosity (mPa · s) | Gel Strength (g/cm$^2$) | Sheet Formation State |
|---|---|---|---|
| Example 1 | 5900 | 1860 | Good |
| Comparative Example 1 | 1240 | 214 | Formation Impossible |

EXAMPLE 2

The same procedures as in Example 1 were followed except that 1.9 g of citric acid was used instead of 1.9 g of malic acid. The same measurement and evaluation were then carried out. Result thus obtained are shown in Table 2. This curdlan gel sheet contained 40% by weight of the leaf tobacco extract.

COMPARATIVE EXAMPLE 2

The same procedures as in Example 2 were followed except that 1.9 g of citric acid was not added. The same measurement and evaluation were then carried out. Results thus obtained are also shown in Table 2.

TABLE 2

| | Slurry Viscosity (mPa · s) | Gel Strength (g/cm$^2$) | Sheet Formation State |
|---|---|---|---|
| Example 2 | 4300 | 1720 | Good |
| Comparative Example 21 | 1080 | 208 | Formation Impossible |

EXAMPLE 3

The entire amount of the leaf tobacco extract obtained by the same manner as in Example 1 was concentrated to 450 g by using a concentrator.

To the entire amount (450 g) of this liquid extract concentrate, 1.3 g of malic acid and 20 g of powder of curdlan, together with a solution (5.3 g) of 2.0 g of lecithine dissolved in 3.3 g of MCT, were added, and then this mixture was stirred at a stirring rotation speed of 3000 rpm while being kept at a temperature of 25° C., to disperse the curdlan into the leaf tobacco extract concentrate. To the obtained dispersed material, 6.7 g of glycerin and 7.0 g of sorbitol were added and then stirred under the same stirring conditions to give a curdlan slurry having an increased viscosity.

A portion of this curdlan slurry was taken off, and its viscosity was measured, and then was gelled and its gel strength was measured, in the same manner as in Example 1.

The remainder of the aforementioned curdlan slurry was used to obtain a curdlan gel sheet in the same manner as in Example 1. The formation state of the curdlan gel sheet was evaluated in the same manner as in Example 1.

Results obtained are shown in Table 3 below. This curdlan gel sheet contained 48% by weight of the leaf tobacco extract.

COMPARATIVE EXAMPLE 3

The same procedures as in Example 3 were followed except that malic acid was not added. The same measurement and evaluation were then carried out. Results thus obtained are also shown in Table 3.

TABLE 3

| | Slurry Viscosity (mPa · s) | Gel Strength (g/cm$^2$) | Sheet Formation State |
|---|---|---|---|
| Example 3 | 4200 | 1710 | Good |
| Comparative Example 3 | 1050 | 190 | Formation Impossible |

As can see from the results shown in Tables 1 to 3, according to the present invention, the dispersion of glucan into the leaf tobacco extract is not interfered, and the glucan dispersion has a high viscosity. Furthermore, gel strength of the obtained sheets is also sufficiently high, and the leaf tobacco extract content within the obtained glucan gel sheets can be also increased.

As described above, the present invention can provide a method for producing a heat-irreversibly coagulated glucan sheet which makes it possible to produce the glucan gel sheet containing a relatively large amount of a leaf tobacco extract in a relatively simple manner.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for producing a heat-irreversibly coagulated glucan sheet, comprising the steps of:

(a) providing a dispersion medium of an aqueous leaf tobacco extract prepared from 20 to 200 parts by weight of leaf tobacco in 1000 parts by weight of water or its concentrate concentrated by 1 to 70% by weight;

(b) providing powder of heat-irreversibly coagulating glucan in a concentration of from 1 to 20% by weight of said extract or concentrate;

(c) providing a dispersion interference-preventing agent comprising an organic acid in an amount of 30% by weight or less of said extract or concentrate;

(d) preparing a mixture by adding said powder of the glucan and said dispersion interference-preventing agent to said dispersion medium;

(e) stirring said mixture to disperse the powder of said glucan into said dispersion medium, thereby forming a slurry having an increased viscosity;

(f) forming said slurry into a sheet form; and (g) heating and coagulating the resultant sheet formed body.

2. The method of claim 1, wherein said mixture prepared in step (d) contains said organic acid in an amount of 1 to 10% by weight of said dispersion medium.

3. The method of claim 1, wherein said dispersion interference-preventing agent comprises an organic carboxylic acid.

4. The method of claim 1, wherein said organic acid is at least one carboxylic acid selected from the group consisting of malic acid, a citric acid, a tartaric acid, succinic acid, lactic acid and mixtures thereof.

5. The method of claim 1, wherein said glucan sheet contains up to 90% by weight of dispersion medium.

6. The method of claim 1, wherein said glucan is curdlan.

7. The method of claim 1, wherein, in step (d), a dissolved matter of an emulsifier dissolved in an oily solvent is further mixed.

8. The method of claim 7, wherein said oily solvent comprises a middle-chain saturated fatty acid triglyceride.

9. The method of claim 7, wherein said oily solvent is contained in an amount of up to 30% by weight of the final glucan sheet.

10. The method of claim 9, wherein the emulsifier is contained in an amount of up to 30% by weight of the final glucan sheet.

11. The method of claim 7, wherein, in step (d), a softening agent comprising a polyhydric alcohol or a saccharide is further mixed.

12. The method of claim 11, wherein the softening agent is contained in an amount of up to 50% by weight of the final glucan sheet.

13. A method for producing a tobacco flavor-generating medium, comprising the steps of:

cutting or pulverizing the heat-irreversibly coagulated glucan sheet obtained by the method according to claim 1;

mixing the obtained cuts or powder with sheet tobacco materials;

forming the resultant mixture into a sheet form; and cutting or pulverizing the resultant sheet body.

14. The method of claim 13, wherein said tobacco flavor-generating medium comprises 100 parts by weight of tobacco powder, from 5 to 20 parts by weight of a reinforcing material, from 1 to 15 parts by weight of a binder, and from 1 to 40 parts by weight of the cuts or powder of said glucan sheet.

* * * * *